United States Patent [19]

Paulin

[11] 4,072,246

[45] Feb. 7, 1978

[54] DISPLAY RACK

[76] Inventor: Arthur Paulin, 7 High Point Road, Don Mills, Canada, M2B 2A3

[21] Appl. No.: 762,618

[22] Filed: Jan. 26, 1977

[51] Int. Cl.[2] ..... A47F 1/12

[52] U.S. Cl. ..... 221/307; 248/307

[58] Field of Search ..... 221/307, 310, 240, 312 A; 211/7, 106, 119; 248/302, 306, 339, 307; 312/184

[56] References Cited

U.S. PATENT DOCUMENTS 2,942,831 6/1960 Adams et al. ..... 248/307

*Primary Examiner*—Stanley H. Tollberg

*Attorney, Agent, or Firm*—Rogers, Bereskin & Parr

[57] ABSTRACT

A display rack for packages of hardware and like articles is described. The rack includes a support and a plurality of elongate elements which project outwardly from the support in generally parallel positions and from which the packages can be suspended. The elements have free outer end portions over which the packages can be slidably fitted onto and removed from the elements and the elements are arranged to incline downwardly to a slight extent away from said support when the rack is in use, so that packages suspended on the elements tend to slide towards said outer end portions under the action of gravity. An elongate stop member is coupled to the support and extends transversely of and above the package support elements adjacent their outer end portions. The elements are normally disposed in contact with the stop member when fully loaded with packages, so the member prevents the packages sliding off the elements. The elements are resiliently deflectable away from the stop member to permit removal of packages.

7 Claims, 3 Drawing Figures

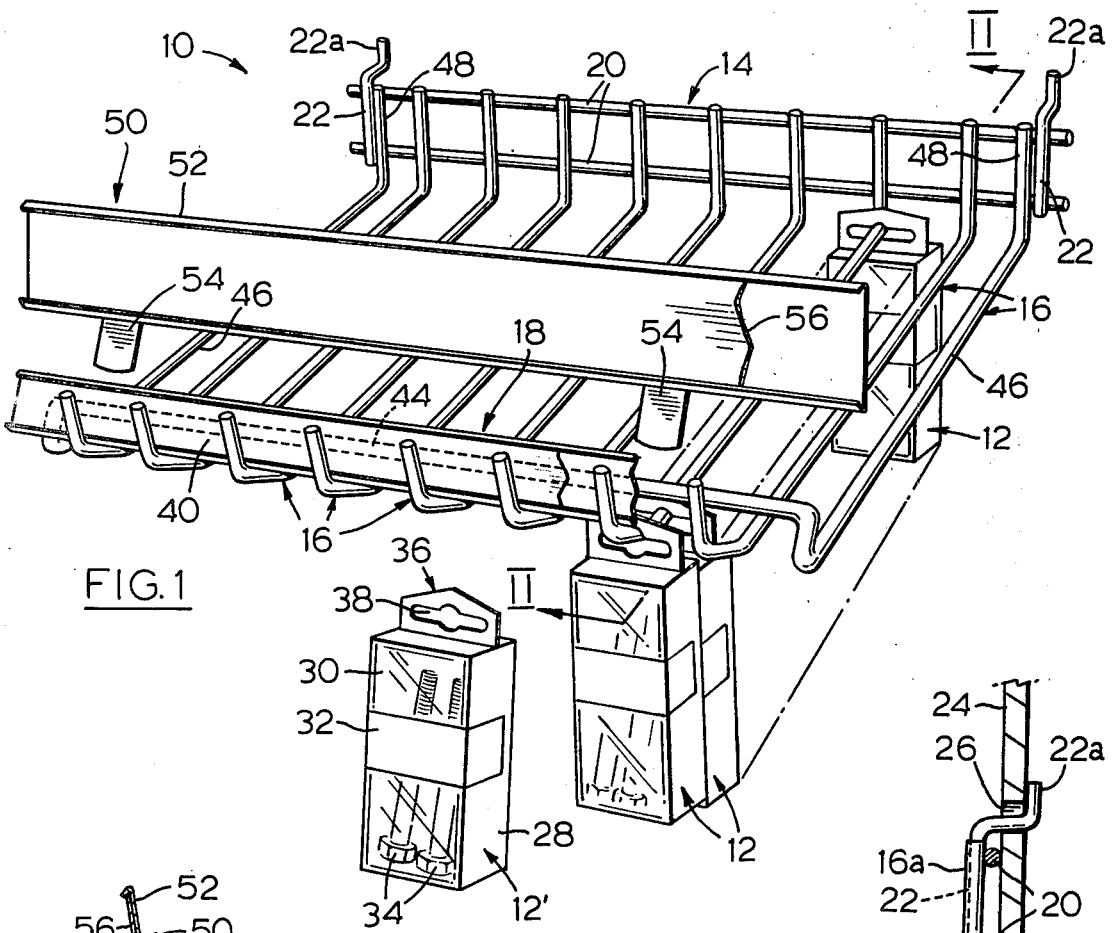
FIG. 1
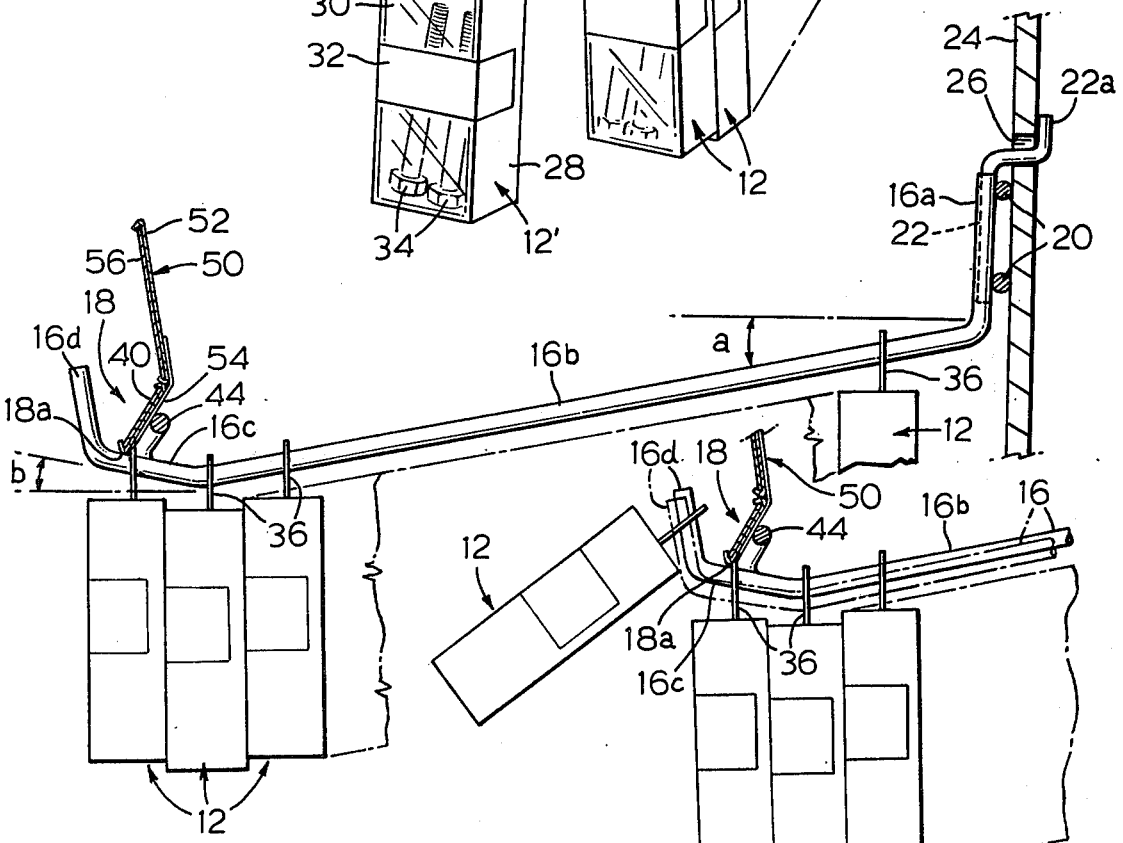
FIG. 2
FIG. 3

DISPLAY RACK

This invention relates to a display rack for packages of hardware and like articles.

It is conventional merchandising practice to offer small quantities of hardware articles for sale in prepackaged form. A package normally comprises a plastic box or the like containing a small number of articles (e.g. screws) of the same type and size. The packages are designed to be suspended from a display rack in a store. Typically, the rack will carry an array of packages containing a range of hardware articles of different types and sizes. The racks are designed to permit customer selection of packages.

Many different types of display racks have previously been proposed. In one simple type, the rack is in the form of a self-standing support structure carrying fixed hooks from which the packages are hung. The structure may be turnable so that packages can be carried on all sides. Another type of display rack employs bars which project outwardly from a support and on which the packages hang. The bars may be inclined downwardly to a slight extent towards their outer ends so that packages tend to feed off the bars by gravity. However, a problem with this type of display rack is that, if the bars are angled sufficiently to permit proper gravity feeding, the packages tend to fall off the ends of the bars. Also, safety is often a problem since the outwardly projecting bars present a danger to the customer. Inflexibility is another problem with this type of rack. Thus, the bars are often arranged in a number of vertically spaced tiers which cannot be adjusted with respect to one another, for example, to allow for packages of different heights.

An object of the present invention is to provide an improved display rack for packages of hardware and like articles.

According to the invention, the rack includes support means and a plurality of elongate elements which project outwardly from the support means in generally parallel positions and from which the packages can be suspended. The elements have free outer end portions over which the packages can be slidably fitted onto and removed from the elements and the elements are arranged to incline downwardly to a slight extent away from said support means when the rack is in use, so that packages suspended on the elements tend to slide towards said outer end portions under the action of gravity. An elongate stop member is coupled to the support means and extends transversely of and above the package support elements adjacent their outer end portions. The elements are normally disposed in contact with the stop member when fully loaded with packages, so the member prevents the packages sliding off the elements. The elements are resiliently deflectable away from the stop member to permit removal of packages.

In order that the invention may be more clearly understood, reference will now be made to the accompanying drawings which illustrate one embodiment thereof by way of example, and in which:

FIG. 1 is a partly exploded perspective view of a package display rack according to the invention;

FIG. 2 is a vertical sectional view on line II—II of FIG. 1; and,

FIG. 3 is a view similar to FIG. 2 illustrating removal of a package from the rack.

Reference will first be made to FIG. 1 which shows the rack in its normal position of use. The rack is generally denoted 10 and a number of packages of hardware articles are shown at 12 suspended from the rack. A further package denoted 12' is shown removed from the rack.

The principal parts of the rack are a support, generally denoted 14, a plurality of elongated package suspension elements 16 spaced along support 14 and a stop member 18 which prevents the packages from sliding off the elements 16 as will be described. Support 14 comprises two transverse circular-section steel rods 20 joined together adjacent opposite ends by two upright rods 22 having angled upper end portions **22*a*. The rack is intended to be fitted to a vertical sheet of peg board by hooking these portions 22*a* of the rods 22 into two horizontally spaced holes at the same level in the peg board. A section of peg board is indicated at 24 in FIG. 2 and shows one of the angled portions 22*a* inserted through a hole 26 in the peg board. It will be seen that the transverse rods 20 of support 14** lie in contact with the outer surface of the peg board at this time. This arrangement allows for great flexibility in the positioning of the rack since it may be readily disengaged from the peg board and relocated, for example, to accommodate packages of different sizes.

The package suspension elements 16 are each made of circular-section spring-steel rod formed in the shape which can be seen in FIG. 2. It will be noted from this view that each rod has an upright inner end portion **16*a*, a main central portion 16*b*, which is the main package supporting portion of the element, an intermediate portion 16*c* in the vicinity of the stop member 18, and a generally upright outer end portion 16*d* disposed in front of the stop member. The inner end portion 16*a* of each element is welded to the two transverse rods 20 of support 14, while the remainder of the element is free. Accordingly, each of the package suspension elements 16** is resiliently deflectable in the downward direction to permit removal of packages from the rack as will be more particularly explained later.

In the meantime, it will be convenient to describe the form of the packages 12 by reference to the package 12' which is shown separate from the rack in FIG. 1; this package may be regarded as a typical example of one of the packages 12. The package includes an injection molded plastic box 28 which is open topped and fitted with a transparent plastic lid 30. The lid is held in place by an adhesive label 32 which is printed to indicate the type and size of the hardware articles contained in the box. In this case, the box contains two bolts which are indicated at 34. At its top end, box 28 is formed with an integral hanging tab 36. Tab 36 is formed with an opening 38 shaped to permit the tab to be threaded over one of the suspension elements 16. The portion of tab 36 surrounding the opening 38 is shaped to define a knife edge so that the tab makes only line contact with the suspension element on which it is fitted. This makes for minimal frictional resistance to movement of the package along the relevant suspension element. For a more detailed description of the package, reference may be made to co-pending Canadian patent application no. 265,506 filed Nov. 12, 1976.

Reference will now be made to FIGS. 2 and 3 which show the package-suspension element 16 of FIG. 1 from which the packages 12 are suspended. For convenience of illustration, not all of the packages on the element have been shown individually. However, it will be appreciated that a considerable number of packages can be carried on each element. Packages may be carried along substantially the entire length of the main central portion 16*b* of the element and along part of the intermediate portion 16*c*, up to the stop member 18. It will also be noted that the individual packages hang vertically downwards in face-to-face contact with one another. This is important from the visual point of view ("fanning" of the packages is unsightly) and is achieved by careful selection of the angle of downward inclination of the central portion 16*b* of the package suspension elements. Also, this angle of inclination must be chosen so as to ensure adequate gravity feeding of the packages along the element. From the point of view of compactness, the inclination should be minimized so as to minimize the vertical height occupied by the rack, and hence maximize the number of racks which can be accommodated in a given display area. In the present embodiment, the angle of downward inclination (*a*) of the central portion 16*b* to horizontal is approximately 10°. The inclination of the intermediate portion 16*c* of element 16 is also important to avoid "fanning" of the packages along this portion. In this embodiment, portion 16*c* is inclined upwardly towards the outer ends of the elements at an angle (*b*) which is approximately 10° to the horizontal. The outer end portion 16*d* of element 16 is inclined upwardly as shown in the drawings. This is primarily a safety feature and avoids having the suspension elements project outwardly directly from the rack, which could lead to injury of a customer. The particular inclination of portion 16*d* is not believed to be critical, although it is thought desirable to angle the portion outwardly of the rack to a slight extent to facilitate removal of the packages from the rack.

To summarize, the package suspension elements 16 of the rack shown in the drawings are specifically shaped to ensure that the packages hang vertically downwards from the element and feed smoothly under gravity towards the stop member 18 as successive packages are removed from the rack.

Stop member 18 acts not only to restrain the packages on the elements 16, but also serves as a carrier for a card bearing product identification information. Thus, member 18 is of shallow channel-shape in cross section as can best be seen from FIGS. 2 and 3. The channel faces forwardly of the rack and receives a narrow, elongate card 40 bearing product identification information (not shown). Typically, card 40 would be preprinted with information identifying the products on each package-suspension element of the rack. This allows the products to be identified other than by the labels on the packages, which is important for restocking the rack when one or more suspension elements are empty. Member 18 is arranged with its channel facing forwardly of the rack and is disposed at a slight rearward inclination for optimum visibility of information on card 40.

Referring now more particularly to the package-restraint function of member 18, it will be noted that all of the suspension elements 16 contact the lower edge 18*a* of member 18 at a position on each element just inwardly of the outer end of the upwardly inclined portion 16*c* (considered in the direction of package movement along the element). Accordingly, the packages do not bear directly against the stop member. The longitudinal portion of the base of member 18 adjacent edge 18*a* co-operates with the tops of the tabs 36 of the packages to normally prevent movement of the packages past the stop member. The rack is constructed so that the package-suspension elements 16 are applied against the stop member 18 under tension and will not deflect out of contact with the stop member even when fully loaded with packages. This pre-tensioning of the suspension elements avoids any possibility of accidental disengagement of the packages from the rack even when the rack is fully loaded.

Stop member 18 is held in place by a generally U-shaped carrier rod 42 having a central portion 44 which extends transversely of the elements 16 behind member 18 and to which the member is spot-welded at each end. Rod 42 includes two side limbs 46 having upwardly directed end portions 48 which are welded to the transverse members 20 of support 14. The central portion 44 of the rod extends between the side limbs 46 and joins each of the latter at an angled portion 50 shaped so that the side limbs 46 lie substantially in a common plane with the central portions 16*b* of the package-suspension elements 16.

It will be appreciated from the foregoing that stop member 18 maintains a substantially fixed position in relation to the elements 16, while the elements can be individually depressed with respect to member 18 to provide clearance between a depressed element and the stop member sufficient to allow removal of a package from the element, or restocking of that element. Thus, referring to FIG. 3, one of the elements 16 is shown in full lines in its normal position in contact with member 18, and in chain-dotted outline at 16' in a depressed position to allow for removal of a package from the element. Depression of the element may conveniently be effected by exerting a downward manual pull on the package to be removed. The action of depressing the element can be effected by downwardly and forwardly displacing the package to be removed. After the package has passed by the bottom edge 18*a* of member 18, the suspension element 16 can be allowed to return to its normal position in contact with member 18.

The rack shown in the drawings is also fitted with a general product heading device such as that shown in an exploded position in FIG. 1 and generally designated 50. This device is optional and need not necessarily be used with the remainder of the rack. Device 50 includes a forwardly facing channel-section member 52 to the rear face of which is welded two depending tongues 54 of relatively thin and flexible form. These tongues are dimensioned to be readily force fitted between the rear face of stop member 18 and the central portion 44 of the support rod 42 for the member. FIGS. 2 and 3 show the device 50 in position. It will be noted that the tongues 54 are angled slightly so that the channel 52 adopts a substantially vertical position. A card 56 is slidably received in channel 52 and may carry any suitable identification information such, for example, as general product information, manufacturer's name, trade marks, etc. It will be appreciated that both card 56 and the card 40 in the lower channel member 18 may be readily removed by sliding longitudinally of the revelant channel member. Accordingly, both cards are reversible and may carry information on both sides. For example, each card could, say, be printed in different languages on respectively opposite sides so that the cards may be inserted to show whichever side is appropriate to a particular location in which the products are being sold.

It is of course to be understood that the preceding description relates to a specific embodiment and that many modifications are possible within the broad scope of the invention. For example, while the rack shown in the drawings has been described for use in association with packages of hardware articles, it is to be understood that there is no limitation in this and that the rack could be used for other packages. Similarly, the packages need not be of the specific form illustrated; it is simply necessary that the packages should be designed for suspension mounting.

It is also to be noted that the rack need not necessarily have the form of support described. In an alternative embodiment, the support 14 could be replaced, for example, by a plane plate or the like adapted to be attached to a vertical surface. A self-standing type of support could even be used. However, a support of the kind shown in the drawings has the advantage that it allows considerable flexibility in installation of the rack. Also, it allows a large number of racks to be accommodated (e.g. in vertically spaced positions) in a relatively limited display area.

The package-suspension element 16 need not necessarily be of the specific form shown. Elements of a different cross sectional shape could be used. In a simple embodiment, the suspension elements could be straight bars with the stop member arranged transversely thereto at a spacing in from their outer ends.

What I claim is:

1. A display rack for packages of hardware and like articles, the rack comprising:

support means;

a plurality of elongate elements from which the packages can be suspended, the elements projecting outwardly from said support means in generally parallel positions and having free outer end portions over which the packages can be slidably fitted onto and removed from the elements, the elements being arranged to incline downwardly to a slight extent away from said support means when the rack is in use, so that packages suspended on the elements tend to slide towards said outer end portions under the action of gravity; and, an elongate stop member coupled to said support means and extending transversely of and above the package suspension elements adjacent their outer end portions, the elements being normally disposed in contact with said stop member when fully loaded with packages so that the stop member prevents the packages sliding off the elements, and the elements being resiliently deflectable away from the stop member to permit removal of the packages.

2. A rack as claimed in claim 1, which is adapted to be removably fitted to an upright support surface, wherein said support means of the rack includes angled coupling elements adapted to engage in openings in said surface and is arranged to support the rack with said elongate suspension elements disposed in said downwardly inclined positions.

3. A rack as claimed in claim 1, wherein said stop member is of shallow channel-shape in cross section and is adapted to slidably receive a carrier bearing information identifying the products contained in the packages on the rack, said member being arranged with its channel in a forwardly facing direction with a lower portion thereof in contact with said suspension elements.

4. A rack as claimed in claim 3, wherein said stop member is coupled to the support means of the rack by a U-shaped carrier having a central portion disposed rearwardly of said member and to which the member is attached, and two side limbs connecting said central portion with said support means of the rack.

5. A rack as claimed in claim 4, wherein said stop member is coupled to said carrier at longitudinally spaced positions, and wherein the rack further includes an initially separate display device comprising a further channel-section member adapted to slidably receive a display carrier, and tongues depending from said carrier and adapted to be forcibly inserted and frictionally retained between said stop member and said carrier.

6. A rack as claimed in claim 1, wherein each package-suspension element includes an upwardly directed outer end portion, an intermediate portion adjacent said end portion and along which said stop member engages said suspension elements, a main downwardly inclined portion along which packages tend to slide by gravity towards said stop member, and an inner end portion coupled to said support means.

7. A rack as claimed in claim 6, wherein each of said package-suspension elements is made of circular-section spring-steel rod and is pre-tensioned to maintain contact between said element and said stop member.

* * * * *